US008072156B2

(12) United States Patent
Morimoto

(10) Patent No.: US 8,072,156 B2
(45) Date of Patent: Dec. 6, 2011

(54) DISCHARGE LAMP OPERATING SYSTEM

(75) Inventor: Sadao Morimoto, Hyogo (JP)

(73) Assignee: Panasonic Corporation, Osaka (JP)

( * ) Notice: Subject to any disclaimer, the term of this patent is extended or adjusted under 35 U.S.C. 154(b) by 499 days.

(21) Appl. No.: 12/303,291

(22) PCT Filed: Jul. 25, 2007

(86) PCT No.: PCT/JP2007/064540
§ 371 (c)(1),
(2), (4) Date: Dec. 3, 2008

(87) PCT Pub. No.: WO2008/013185
PCT Pub. Date: Jan. 31, 2008

(65) Prior Publication Data

US 2009/0195173 A1 Aug. 6, 2009

(30) Foreign Application Priority Data

Jul. 28, 2006 (JP) ..... 2006-205913

(51) Int. Cl.
*H05B 41/16* (2006.01)

(52) U.S. Cl. ..... 315/277; 315/274; 315/325

(58) Field of Classification Search ..... 315/274–289, 315/312–326
See application file for complete search history.

(56) References Cited

U.S. PATENT DOCUMENTS

| | | | | |
|---|---|---|---|---|
| 7,242,147 | B2 | 7/2007 | Jin | |
| 7,443,108 | B2 * | 10/2008 | Meng et al. | 315/276 |
| 7,589,478 | B2 * | 9/2009 | Ushijima et al. | 315/277 |
| 2004/0155596 | A1 | 8/2004 | Ushijima et al. | |
| 2005/0093471 | A1 * | 5/2005 | Jin | 315/177 |

FOREIGN PATENT DOCUMENTS

| | | |
|---|---|---|
| JP | 9-190889 | 7/1997 |
| JP | 2004-335443 | 11/2004 |
| JP | 2005-039050 | 2/2005 |
| JP | 2006-012659 | 1/2006 |
| JP | 2006-049469 | 2/2006 |
| JP | 2006-164785 | 6/2006 |
| WO | 2005/038828 | 4/2005 |

OTHER PUBLICATIONS

International Search Report issued Oct. 30, 2007 in the International (PCT) Application of which the present application is the U.S. National Stage.
English translation of JP 2006-164785, Jun. 2006.

* cited by examiner

*Primary Examiner* — James H Cho
(74) *Attorney, Agent, or Firm* — Wenderoth, Lind & Ponack, L.L.P.

(57) ABSTRACT

A discharge lamp operating system has first and second discharge lamp operating circuits. The first discharge lamp operating circuit includes first and second primary windings, a first secondary winding, a first discharge lamp connected to the first primary winding, and a second discharge lamp connected to the second primary winding. The second discharge lamp operating circuit includes third and fourth primary windings, a second secondary winding, a third discharge lamp connected to the third primary winding, and a fourth discharge lamp connected to the fourth primary winding. The first secondary winding and the second secondary winding are connected in series.

6 Claims, 10 Drawing Sheets

FIG. 10 – PRIOR ART
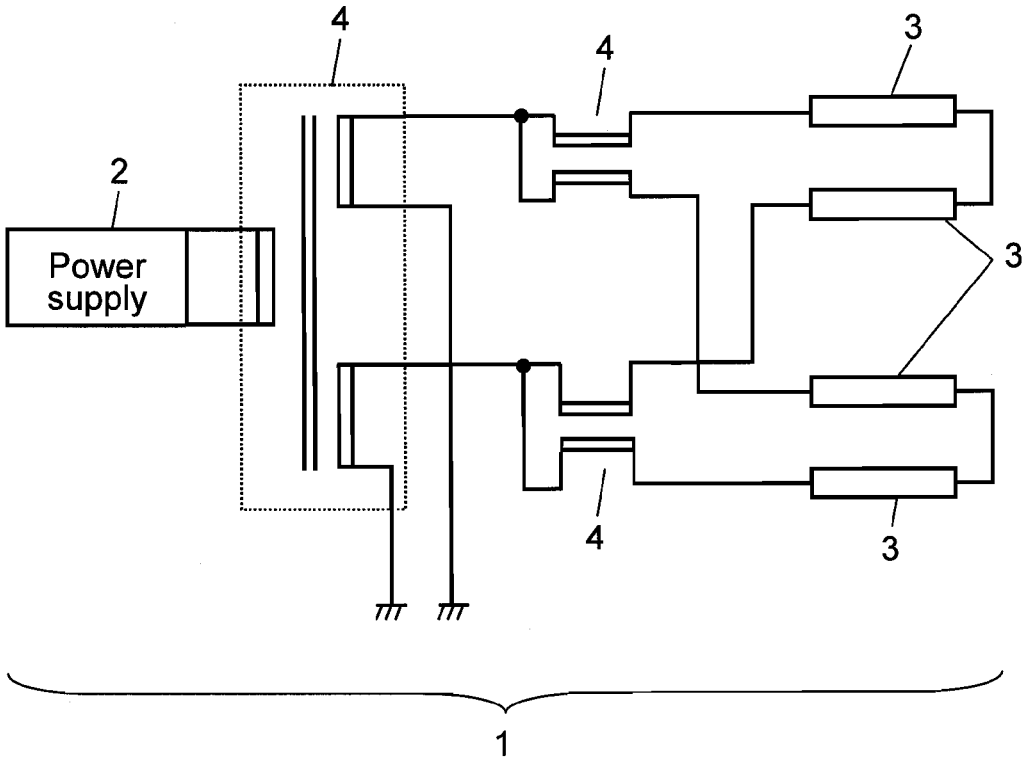

DISCHARGE LAMP OPERATING SYSTEM

This application is a U.S. national phase application of PCT International Application PCT/JP2007/064540, filed Jul. 25, 2007.

TECHNICAL FIELD

The present invention relates to a discharge lamp operating system for a multi-lamp in a display device for use in various types of electronic equipment or the like.

BACKGROUND ART

With reference to FIG. 10, a description is provided of a conventional discharge lamp operating system for a multi-lamp. In cold-cathode tube discharge lamp operating system 1, power supply 2 allows a plurality of discharge lamps 3 for radiating a panel to light up at the same time.

In recent years, with increases in screen size, it is required in a liquid crystal display that multiple discharge lamps 3 for radiating the panel be lit and the voltage be increased to support the high brightness of respective discharge lamps 3. In a discharge lamp operating system using multiple discharge lamps 3, the brightness of respective discharge lamps 3 need be equalized. When this balance is inaccurate, high brightness portions and low brightness portions appear on one liquid crystal display as brightness unevenness, which may make the screen difficult to see.

The variation in impedance between respective discharge lamps 3 is one of the causes for occurrence of such brightness unevenness. In order to prevent such brightness unevenness, balance coil 4 is incorporated into the discharge lamp operating circuit for a so-called multi-lamp system using a centralized power supply. Balance coil 4 is used to accommodate the impedance variations and to keep the balance of power to be supplied to respective discharge lamps 3. The balance coil suppresses brightness unevenness between discharge lamps 3. Such a discharge lamp operating system is disclosed in Patent Document 1, for example.

However, when balance coils 4 are used, N−1 pieces of balance coils 4 are necessary for N pieces of discharge lamps 3 in one discharge lamp operating circuit. An increase in the number of balance coils 4 increases the transmission loss at a power conversion, the number of components, the mounting area, or the production cost resulting from the increase in the number of components.

Patent Document 1: Japanese Patent Unexamined Publication No. 2004-335443

SUMMARY OF THE INVENTION

The present invention is directed to provide a discharge lamp operating system in which an increase in the number of components is suppressed. The discharge lamp operating system has a first discharge lamp operating circuit and a second discharge lamp operating circuit. The first discharge lamp operating circuit includes first and second primary windings, a first secondary winding, a first discharge lamp connected to the first primary winding, and a second discharge lamp connected to the second primary winding. The second discharge lamp operating circuit includes third and fourth primary windings, a second secondary winding, a third discharge lamp connected to the third primary winding, and a fourth discharge lamp connected to the fourth primary winding. The first secondary winding and the second secondary winding are connected in series. This structure can average the current flowing in a loop formed of the first secondary winding and the second secondary winding. The averaging of the current contributes to equalization of the brightness of the plurality of discharge lamps. Further, the number of balance coils each including two primary windings and one secondary winding is half the number of discharge lamps. Thus, the number of components is reduced.

BRIEF DESCRIPTION OF THE DRAWINGS

FIG. 10 is a connection diagram of a conventional discharge lamp operating system.

DETAILED DESCRIPTION OF PREFERRED EMBODIMENTS

First Exemplary Embodiment

Figure 1:
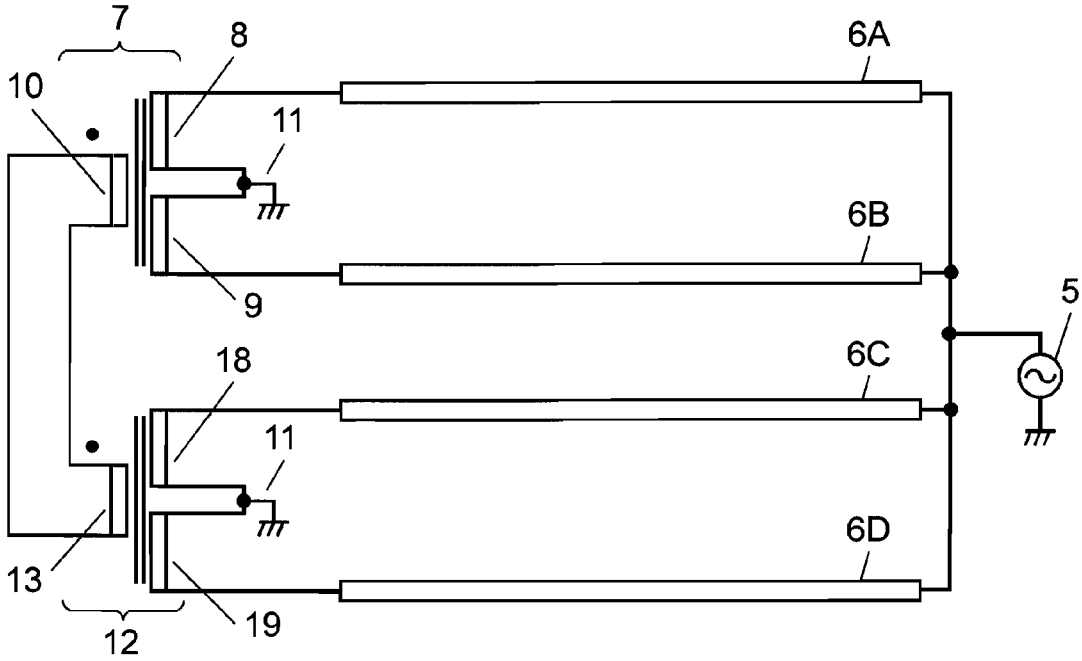
FIG. 1 is a circuit diagram of a discharge lamp operating system in accordance with a first exemplary embodiment of the present invention.

FIG. 1 is a circuit diagram of a discharge lamp operating system in accordance with the first exemplary embodiment of the present invention. Balance coil 7 has first primary winding 8 and second primary winding 9 (hereinafter referred to as primary windings 8 and 9), and first secondary winding 10 (hereafter, secondary winding 10). Similarly, balance coil 12 has third primary winding 18 and fourth primary winding 19 (hereinafter, primary windings 18 and 19), and second secondary winding 13 (hereafter, secondary winding 13). Balance coils 7 and 12 are transformer parts in this circuit.

One end of primary winding 8 is connected to first discharge lamp 6A (hereinafter, discharge lamp 6A). One end of primary winding 9 is connected to second discharge lamp 6B (hereinafter, discharge lamp 6B). The other ends of primary windings 6A and 6B are connected to ground terminal 11. Similarly, one end of each of primary winding 18 and primary winding 19 is connected to third discharge lamp 6C and fourth discharge lamp 6D (hereinafter, discharge lamps 6C and 6D). The other ends of the primary windings are connected to ground terminal 11. The other ends of the plurality of discharge lamps 6A through 6D that are opposite to the ends connected to primary windings 8, 9, 18, or 19 are connected to the same power supply 5. In other words, discharge lamps 6A through 6D are connected in parallel with each other. Secondary winding 10 is connected in series with secondary winding 13 to form a loop. Primary, windings 8 and 9, secondary winding 10, and discharge lamps 6A and 6B constitute a first discharge lamp operating circuit. Primary windings 18 and 19, secondary winding 13, and discharge lamps 6C and 6D constitute a second discharge lamp operating circuit.

Figure 2:
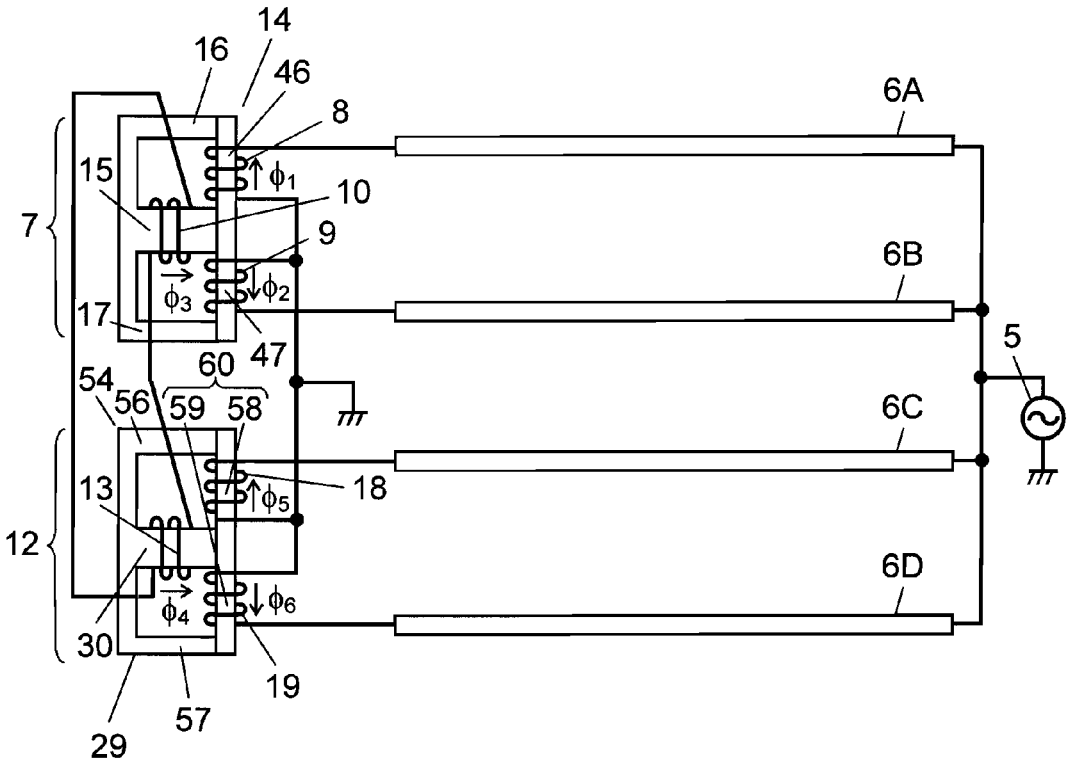
FIG. 2 is a connection diagram of the discharge lamp operating system shown in FIG. 1.

FIG. 2 is a connection diagram of this discharge lamp operating system and shows how primary windings 8 and 9, and secondary winding 10 are arranged in balance coil 7 connected to discharge lamps 6A and 6B.

First closed magnetic-circuit core 14 includes first mid leg 15 (hereinafter, mid leg 15), first outer leg 16 and second outer leg 17 (hereinafter, outer legs 16 and 17), first connecting leg 46, and second connecting leg 47. First connecting leg 46 connects mid leg 15 and outer leg 16. Second connecting leg 47 connects mid leg 15 and outer leg 17. Primary winding 8 is wound around connecting leg 46, and primary winding 9 is wound around connecting leg 47. Alternatively, primary winding 8 may be wound around outer leg 16, and primary winding 9 may be wound around outer leg 17.

The winding direction or connection of primary windings 8 and 9 is set so that the magnetic flux $\phi_1$ generated by primary winding 8 and the magnetic flux $\phi_2$ generated by primary winding 9 are in the directions opposite to each other. In other words, primary windings 8 and 9 perform a differential operation.

Similarly, second closed magnetic-circuit core 54 includes second mid leg 30 (hereinafter, mid leg 30), third outer leg 56 and fourth outer leg 57 (hereinafter, outer legs 56 and 57), third connecting leg 58, and fourth connecting leg 59. Third connecting leg 58 connects mid leg 30 and outer leg 56. Fourth connecting leg 59 connects mid leg 30 and outer leg 57. Primary winding 18 is wound around connecting leg 58, and primary winding 19 is wound around connecting leg 59. Alternatively, primary winding 18 may be wound around outer leg 56, and primary winding 19 may be wound around outer leg 57.

The winding direction or connection of primary windings 18 and 19 is set so that the magnetic flux $\phi_5$ generated by primary winding 18 and the magnetic flux $\phi_6$ generated by primary winding 19 are in the directions opposite to each other. In other words, primary windings 18 and 19 perform a differential operation.

As described above, secondary winding 10 is connected in series with secondary winding 13 to form a loop. The winding direction or connection of secondary windings 10 and 13 is set so that the direction of current generated in secondary winding 10 is the same as the direction of current generated in secondary winding 13.

With this structure, the magnetic flux $\phi_3$ is excited in secondary winding 10 in the same direction as those of the magnetic fluxes $\phi_1$ and $\phi_2$ generated in primary windings 8 and 9, respectively. Similarly, the magnetic flux $\phi_4$ is excited in secondary winding 13 in the same direction as those of the magnetic fluxes $\phi_5$ and $\phi_6$ generated in primary windings 18 and 19, respectively.

When the directions of the magnetic fluxes $\phi_1$ and $\phi_2$ are opposite to those shown in FIG. 2, and the directions of the magnetic fluxes $\phi_5$ and $\phi_6$ are the same as those shown in FIG. 2, the winding direction or connection is set so that the direction of the magnetic flux $\phi_3$ is opposite to that shown in FIG. 2 and the direction of the magnetic flux $\phi_4$ is the same as that shown in FIG. 2.

In other words, the magnetic flux $\phi_1$ generated in primary winding 8 and the magnetic flux $\phi_2$ generated in primary winding 9 flow through mid leg 15 having secondary winding 10 wound thereon in the relation as shown by the following Equation (1). Then, the magnetic flux $\phi_3$ generates current in secondary winding 10. In similar to the case of balance coil 7, current is also generated in secondary winding 13 in balance coil 12.

$$\phi_3=\phi_1+\phi_2 \tag{1}$$

Secondary winding 10 and secondary winding 13 are connected in series in the form of a loop. Thus, the current flowing through this loop is averaged. The averaged current also allows the magnetic fluxes $\phi_3$ and $\phi_4$ to be averaged. As a result, the magnetic fluxes $\phi_1$, $\phi_2$, $\phi_5$, and $\phi_6$ are averaged, which contributes to equalization of the brightness of discharge lamps 6A through 6D.

In other words, in this exemplary embodiment, primary windings 8, 9, 18, and 19 allow brightness stabilization in balance coils 7 and 12, i.e. corresponding transformer parts. At the same time, the loop connection between secondary windings 10 and 13 allows brightness stabilization over the plurality of transformer parts. For ease of explanation, the descriptions are provided of an example in which the number of transformer parts is two. However, the number of transformer parts is not specifically limited.

Next, a description is provided of the operation and advantage of the discharge lamp operating system for multi-lamp in accordance with this exemplary embodiment. In the discharge lamp operating system in accordance with this exemplary embodiment, variations in the discharge current flowing into discharge lamps 6A through 6D caused by variations in characteristics, particularly impedance, between discharge lamps 6A through 6D can be suppressed. As a result, variations in brightness between discharge lamps 6A through 6D can be suppressed.

Figure 3:
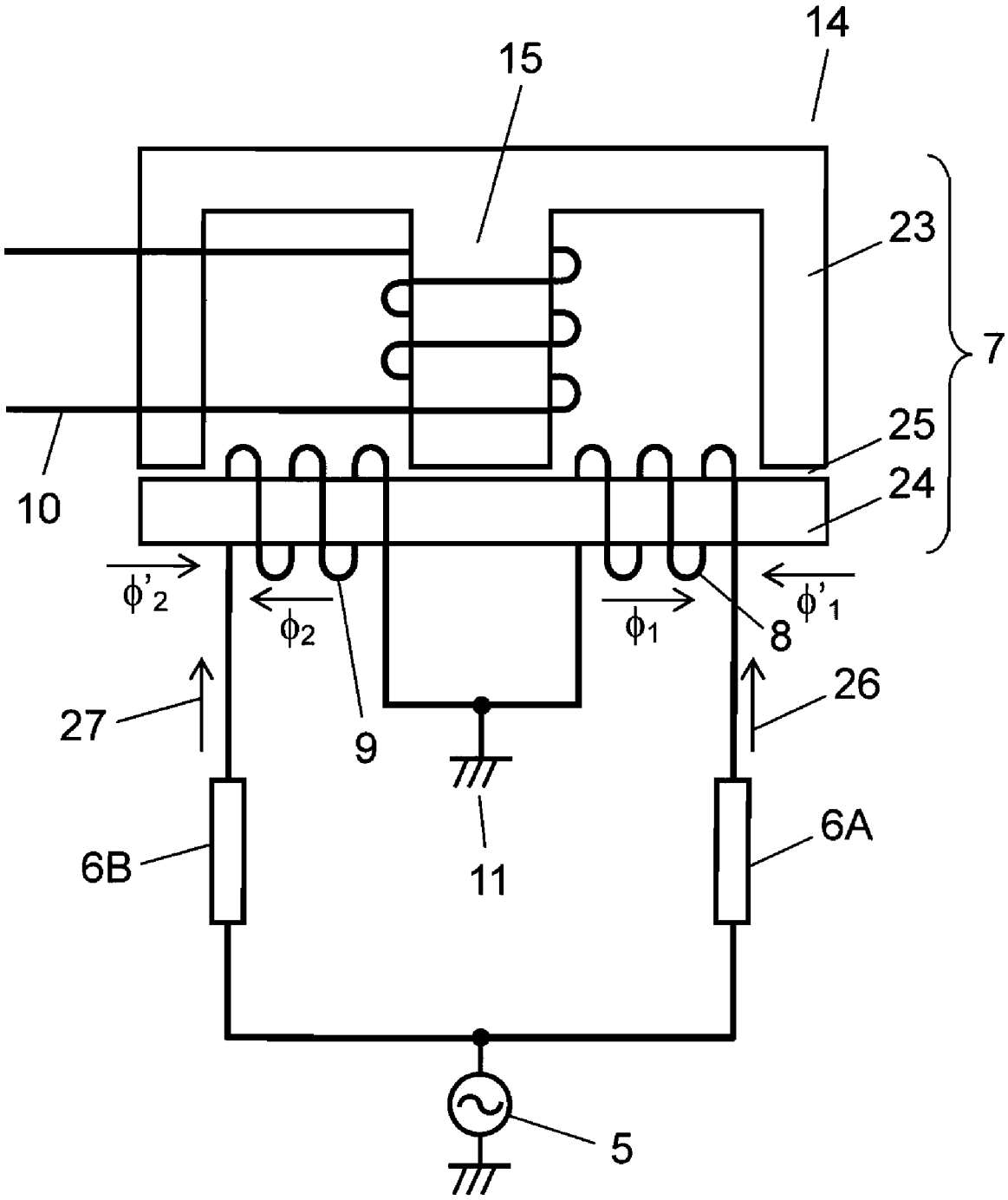
FIG. 3 is a connection diagram of a transformer part in the discharge lamp operating system shown in FIG. 1.

First, with reference to FIG. 3, the advantage in single balance coil 7 is detailed. FIG. 3 is a connection diagram of balance coil 7, which is a transformer part of the discharge lamp operating system shown in FIG. 1.

As shown in FIG. 3, the closed magnetic circuit of balance coil 7 is formed of first E-shaped magnetic core 23, first I-shaped magnetic core 24 with magnetic gap 25 provided therebetween. This gap is provided to prevent magnetic saturation in E-shaped magnetic core 23 and I-shaped magnetic-core 24. Instead of providing magnetic gap 25, increasing the inductance values, i.e. impedance values, of primary windings 8 and 9 can reduce the ratio of impedance values of discharge lamps 6A and 6B relatively with the windings. Whether to provide magnetic gap 25 or not can be selected depending on the situation. As shown in FIG. 2, similarly, also the closed magnetic circuit of balance coil 12 is formed of second E-shaped magnetic core 29 and second I-shaped magnetic core 60.

One end of each of discharge lamp 6A and discharge lamp 6B is connected in parallel with power supply 5. The other ends of discharge lamps 6A and 6B are connected to first and second primary windings 8 and 9, respectively.

Preferably, the impedance of discharge lamps 6A and 6B is set at a value as small as possible with respect to the impedance of primary windings 8 and 9, respectively. This setting can relatively minimize the difference in impedance between the circuit connecting power supply 5, discharge lamp 6A, primary winding 8 and ground terminal 11, and the circuit connecting power supply 5, discharge lamp 6B, primary winding 9, and ground terminal 11 even when the impedance of primary winding 8 is different from that of primary winding 9. In other words, this setting reduces the difference between discharge current 26 flowing into discharge lamp 6A and discharge current 27 flowing into discharge lamp 6B. As a result, a brightness difference between discharge lamp 6A and discharge lamp 6B is unlikely to appear.

The impedance of discharge lamp 6A cannot be completely matched to that of discharge lamp 6B because impedance variations are caused at mass production. However, the impedance value of primary winding 8 can be matched to that of primary winding 9 by forming primary winding 8 and primary winding 9 so that both windings have substantially an equal number of turns. Thus, the impedance value of the circuit portion made of primary winding 8 and discharge lamp 6A can be approximated to that of the circuit portion made of primary winding 9 and discharge lamp 6B. Further, first windings 8 and 9 are wound or connected so that the magnetic flux $\phi_1$ generated in primary winding 8 and the magnetic flux $\phi_2$ generated in primary winding 9 are in differential directions.

Further, as shown in FIG. 2, secondary winding 10 is connected in series with secondary winding 13 of balance coil 12. Each of the secondary windings has the number of turns extremely smaller than those of primary windings 8 and 9 and lower impedance. Thus, a structure like a short ring is formed.

For instance, when the impedance of discharge lamp 6B is larger than that of discharge lamp 6A, the value of discharge current 26 is larger than that of discharge current 27 for a minute time period in the initial state of lighting. As a result, discharge lamp 6A has a higher brightness than discharge lamp 6B. Then, the relation shown by the following Expression (2) holds between the magnetic flux $\phi_1$ generated in primary winding 8 and the magnetic flux $\phi_2$ generated in primary winding 9.

$$\phi_1>\phi_2 \tag{2}$$

Figure 4:
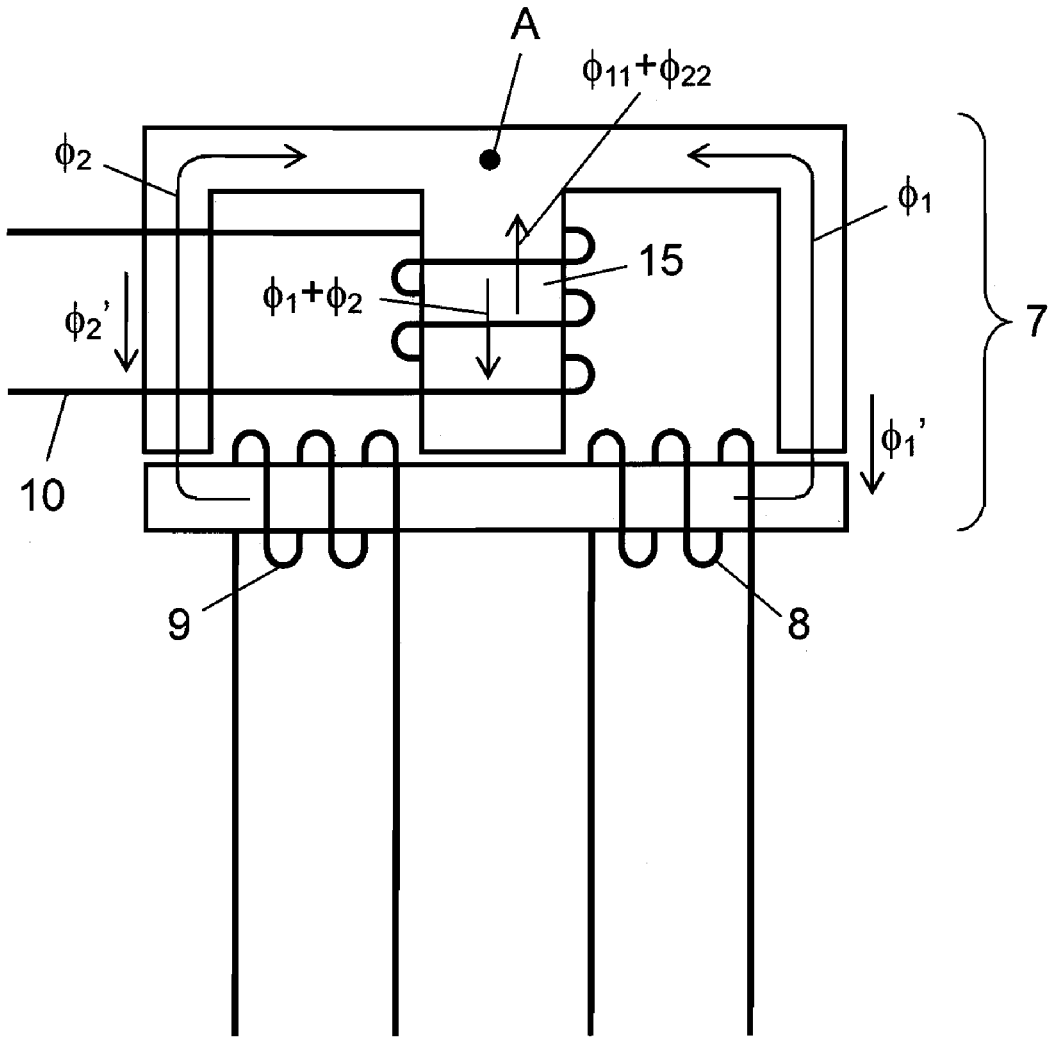
FIG. 4 is a connection diagram showing magnetic flux flowing in the transformer part shown in FIG. 3.

At this time, as shown in FIG. 4, the magnetic flux $\phi_1$ generated in primary winding 8 and the magnetic flux $\phi_2$ generated in primary winding 9 are in differential directions. Thus, the magnetic fluxes join at the point A and the magnetic flux $(\phi_1+\phi_2)$ goes through mid leg 15.

Next, in secondary winding 10 connected in series with secondary winding 13 of balance coil 12, current excited by the magnetic flux $(\phi_1+\phi_2)$ is generated. At the same time, the magnetic flux $(\phi_{11}+\phi_{22})$ is generated to cancel out the magnetic flux $(\phi_1+\phi_2)$.

Because the magnetic flux $(\phi_{11}+\phi_{22})$ is generated to cancel out the magnetic flux $(\phi_1+\phi_2)$, the relation shown by the following Equation (3) substantially holds.

$$\phi_1+\phi_2=\phi_{11}+\phi_{22} \tag{3}$$

Now, assume that E-shaped magnetic core 23 and I-shaped magnetic core 24 are substantially symmetrical with respect to mid leg 15, and the magnetic reluctance of the magnetic path for allowing the passage of the magnetic flux $\phi_1$ is approximate to the magnetic reluctance of the magnetic path for allowing the passage of the magnetic flux $\phi_2$. In this case, when the direction toward primary winding 8, i.e. the opposite direction of the magnetic flux $\phi_1$, and the direction toward primary winding 9, i.e. the opposite direction of the magnetic flux $\phi_2$, are seen from the point A, the values of magnetic reluctance are substantially equal to each other.

Thus, the magnetic flux $(\phi_{11}+\phi_{22})$ is equally distributed at the point A. In other words, each of the magnetic flux $\phi_1'$ flowing from the point A toward primary winding 8 and the magnetic flux $\phi_2'$ flowing from the point A toward primary winding 9 is expressed by $(\phi_{11}+\phi_{22})/2$.

As described above, the relations of Expression (2) and Equation (3) are satisfied. Thus, the relations shown by the following Expression (4) and Expression (5) are satisfied as absolute values. In other words, the magnetic flux going through primary winding 8 as shown in FIG. 3 becomes smaller than that in the initial state. In contrast, the magnetic flux going through primary winding 9 becomes larger.

$$\phi_1>(\phi_1+\phi_2)/2=\phi_1' \tag{4}$$

$$\phi_2<(\phi_1+\phi_2)/2=\phi_2' \tag{5}$$

These phenomena mean that discharge current 26 flowing into discharge lamp 6A decreases and discharge current 27 flowing into discharge lamp 6B increases. In other words, equalizing the magnetic fluxes interlinked with primary winding 8 and primary winding 9 allows also the discharge current to be equalized. With the above operations, discharge current 26 and discharge current 27 converge toward substantially an equal value. As a result, discharge lamps 6A and 6B connected to balance coil 7 have substantially an equal brightness.

Further, in balance coil 7, secondary winding 10 is wound around mid leg 15 of E-shaped magnetic core 23. As shown in FIG. 2, secondary winding 10 is connected in series with secondary winding 13 that is wound around mid leg 30 of E-shaped magnetic core 29 constituting balance coil 12. Secondary windings 10 and 13 are set to have substantially an equal number of turns and substantially an equal inductance value. Further, the positional relations of secondary winding 10 with respect to primary windings 8 and 9, and of secondary winding 13 with respect to primary windings 18 and 19 are matched as well as the winding directions thereof are matched. This structure makes the brightness of discharge lamps 6A and 6B connected to balance coil 7 substantially equal to the brightness of discharge lamps 6C and 6D connected to balance coil 12.

For instance, assume a state where the impedance values of discharge lamps 6A and 6B connected to balance coil 7 are lower than those of discharge lamps 6C and 6D connected to balance coil 12. In this case, for a minute time period in the initial state of lighting, the absolute values of the magnetic fluxes $\phi_1$ and $\phi_2$ generated by primary windings 8 and 9 are larger than the absolute values of the magnetic fluxes $\phi_5$ and $\phi_6$ generated by primary windings 18 and 19. At this time, the value of the magnetic flux $\phi_3$ generated by confluence of the magnetic fluxes $\phi_1$ and $\phi_2$ is larger than the value of the magnetic flux $\phi_4$ generated by confluence of the magnetic fluxes $\phi_5$ and $\phi_6$.

Figure 5:
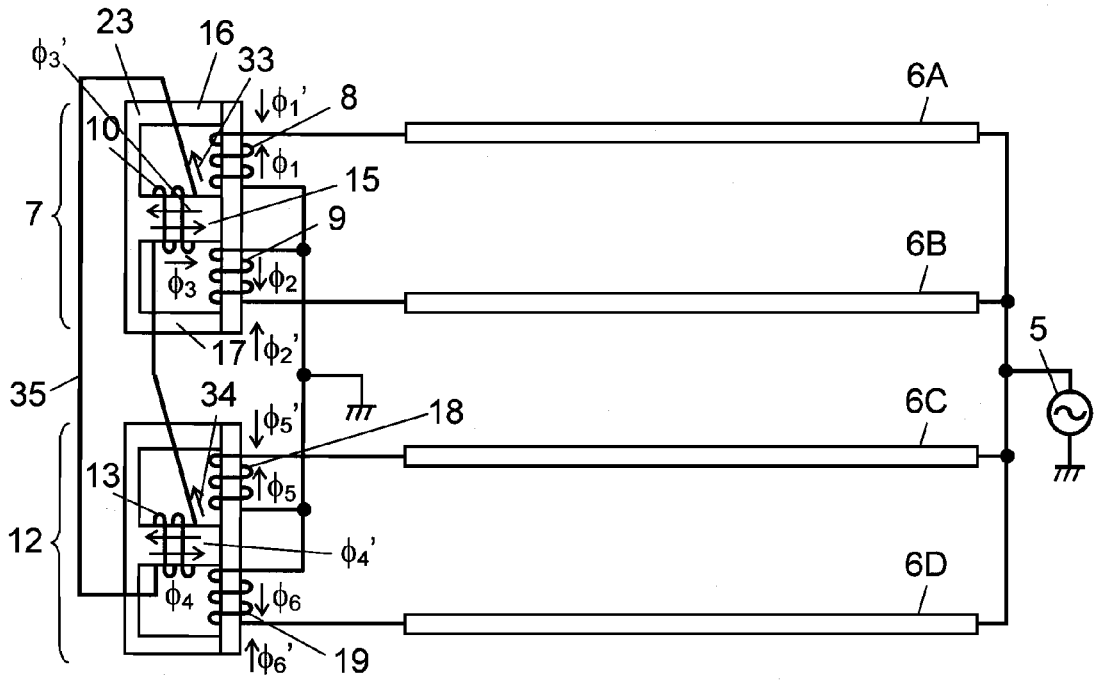
FIG. 5 is a connection diagram showing current flowing between transformer parts in the discharge lamp operating system shown in FIG. 1.

Secondary windings 10 and 13 are connected in series. Further, as shown in FIG. 5, secondary windings 10 and 13 are connected so that current 33 excited by the magnetic flux $\phi_3$ and current 34 excited by the magnetic flux $\phi_4$ flow in the same direction. Secondary windings 10 and 13 are set to have substantially an equal number of turns and substantially an equal inductance value. This setting makes the total impedance of secondary loop 35 formed of secondary windings 10 and 13 approximately twice the impedance of secondary winding 10.

As for the current flowing through secondary loop 35 including secondary windings 10 and 13, the impedance of secondary loop 35 is doubled by secondary windings 10 and 13. Thus, when the magnitude of current 33 is indicated as $I_3$ and the magnitude of current 34 as $I_4$, the average value thereof is $(I_3+I_4)/2$. $I_3$ and $I_4$ can be replaced with the magnetic fluxes $\phi_3$ and $\phi_4$, respectively. Therefore, each of the magnetic fluxes $\phi_3'$ and $\phi_4'$ that are generated to cancel out the Magnetic fluxes $\phi_3$ and $\phi_4$ generated by the current flowing through secondary winding 10 and secondary winding 13, respectively, is the average value of the magnetic fluxes $\phi_3$ and $\phi_4$, i.e. $(\phi_3+\phi_4)/2$.

On an original assumption of $\phi_3>\phi_4$, the relations shown by the following Expressions (6) and (7) are satisfied. In other words, the magnetic flux going through secondary winding 10 as shown in FIG. 5 becomes smaller than that in the initial state. In contrast, the magnetic flux going through secondary winding 13 becomes larger.

$$\phi_3>(\phi_3+\phi_4)/2=\phi_3' \quad (6)$$

$$(\phi_4<(\phi_3+\phi_4)/2=\phi_4' \quad (7)$$

In this manner, the changes in the magnetic fluxes $\phi_3$ and $\phi_4$ allow the magnetic fluxes to be equalized. This operation also equalizes the magnetic fluxes $\phi_1'$ and $\phi_2'$ generated in primary windings 8 and 9 in balance coil 7 and the magnetic fluxes $\phi_5'$ and $\phi_6'$ generated in primary windings 18 and 19 in balance coil 12. As a result, the brightness of discharge lamps 6A, 6B, 6C, and 6D can be substantially equalized.

In the example shown in FIG. 2, descriptions are provided of a structure of using two balance coils 7 and 12, for ease of explanation. However, the number of balance coils is not specifically limited. This example can be applied to a discharge lamp operating system for a multi-lamp when a plurality of balance coils are used and the respective secondary sides thereof are connected in series.

In this manner, in balance coil 7, secondary winding 10 keeps the balance of primary windings 8 and 9. In balance coil 12, secondary winding 13 keeps the balance of primary coils 18 and 19. At the same time, secondary windings 10 and 13 work to keep the balance of balance coils 7 and 12.

The above method allows 2N pieces of discharge lamps to light up with respect to N pieces of balance coils, and prevents brightness unevenness between a plurality of discharge lamps when they are lit. Further, the above method can suppress an increase in the transmission loss at a power conversion, the number of components, the mounting area, and the production cost resulting from the increase in the number of components.

Figure 6:
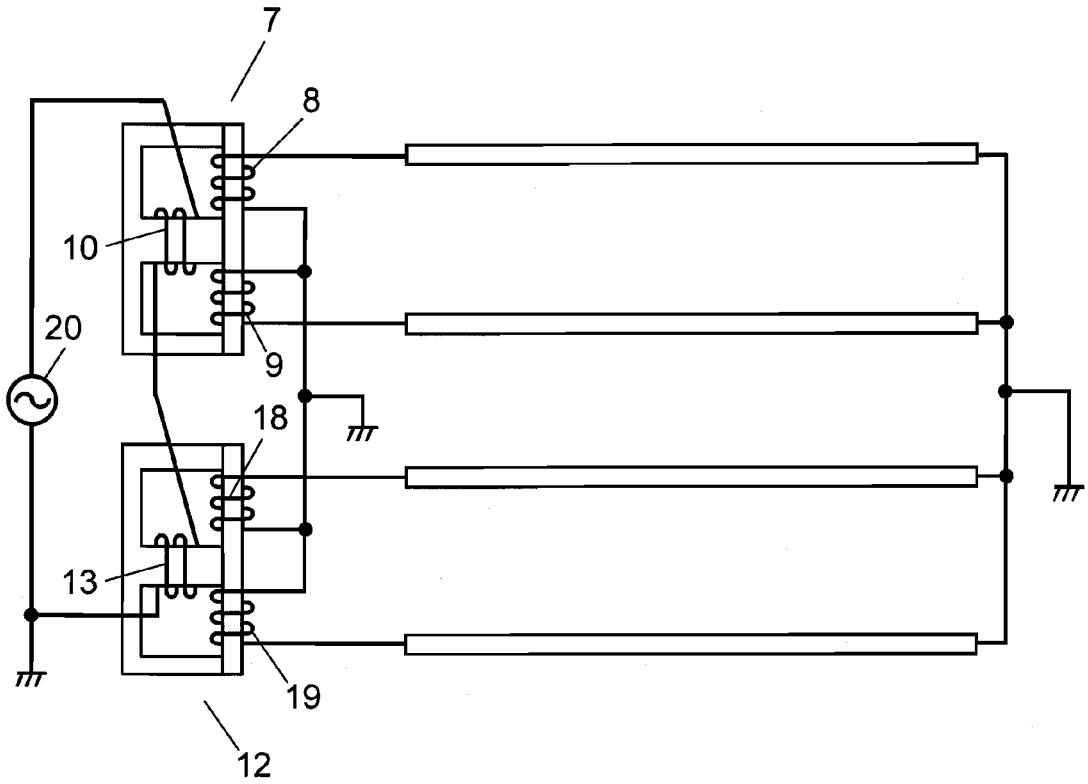
FIG. 6 is a connection diagram in which a power supply is connected in a position different from the position in the discharge lamp operating system shown in FIG. 1.

As shown in FIG. 6, power supply 20 can be provided in series with secondary windings 10 and 13. In this connection method, primary windings 8 and 9 and secondary winding 10 in balance coil 7 are at high potential. Accordingly, this connection method eliminates the need to consider or provide insulation between primary windings 8 and 9 and secondary winding 10. Thus, the distance between the windings can be reduced, which reduces the size of balance coil 7. This advantage also applies to primary windings 18 and 19 and secondary winding 13 in balance coil 12.

Second Exemplary Embodiment

Figure 7:
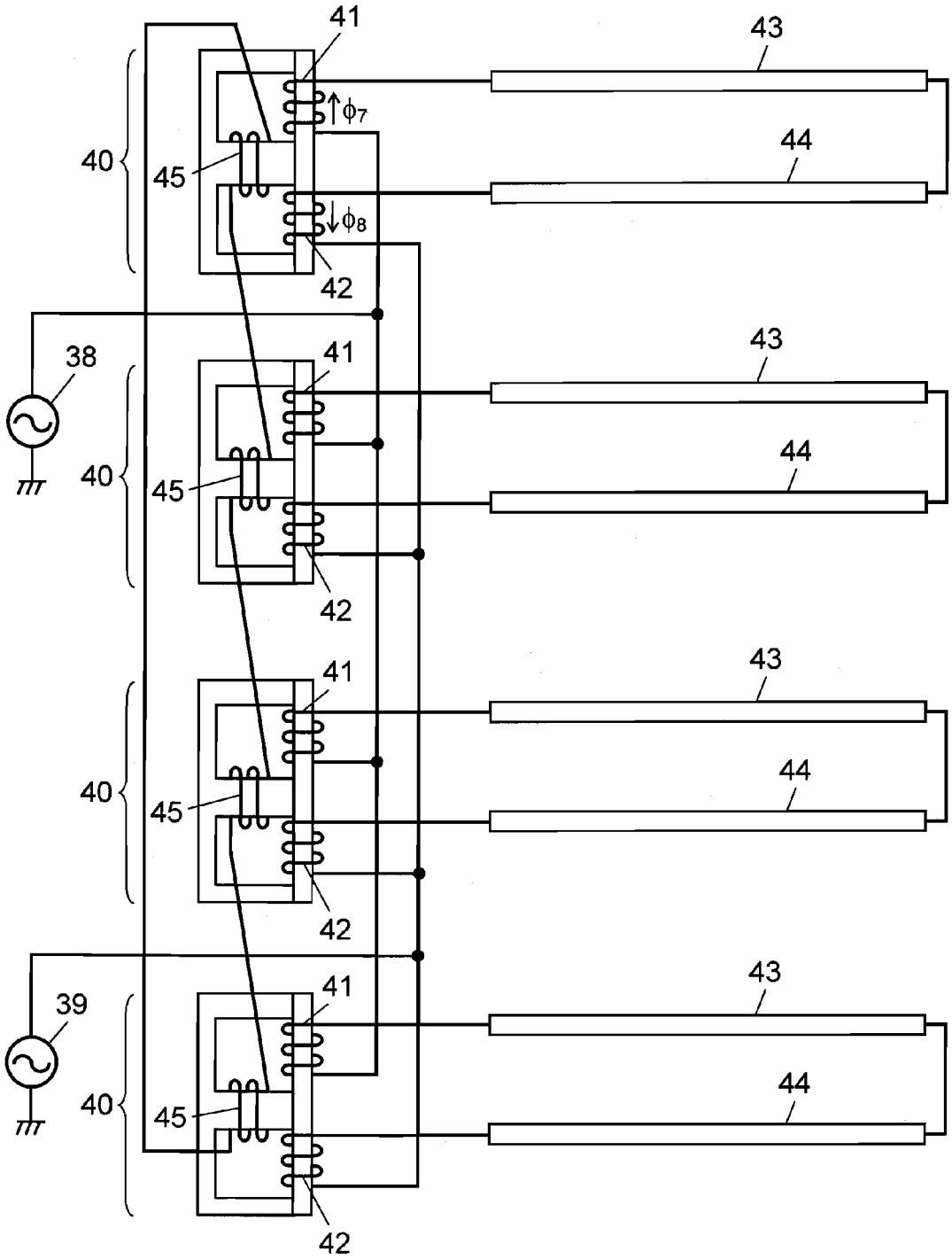
FIG. 7 is a connection diagram of a discharge lamp operating system in accordance with a second exemplary embodiment of the present invention.

FIG. 7 is a connection diagram of a discharge lamp operating system in accordance with the second exemplary embodiment of the present invention. Each of a plurality of balance coils 40 includes first primary winding 41 and second primary winding 42 (hereinafter, primary windings 41 and 42), and secondary winding 45. Power supply 38 is connected to one end of each of primary windings 41, and power supply 39 is connected to one end of each of primary windings 42. To each of the other ends of primary windings 41, one end of each of discharge lamps 43 is connected. To each of the other ends of primary windings 42, one end of each of discharge lamps 44 is connected. The other ends of discharge lamps 43 are connected to the other ends of corresponding discharge lamps 44. Power supplies. 38 and 39 are in opposite phase.

All of secondary windings 45 are connected in series. In similar manner to the first exemplary embodiment, primary windings 41 and 42 are set so as to perform a differential operation in which magnetic fluxes are generated in opposite directions. The winding direction or connection of secondary windings 45 is set so that current is generated in the same direction in the loop formed of the plurality of secondary windings 45.

Also in such a circuit structure, the variation in impedance between discharge lamps 43 and 44 makes the magnetic flux $\phi_7$ and the magnetic flux $\phi_8$ in an unbalanced state for a minute time period in the initial state of lighting. However, the same operation in the first exemplary embodiment equalizes the magnetic flux $\phi_7$ and the magnetic flux $\phi_8$, and the current flowing into discharge lamp 43 and the current flowing into discharge lamp 44. As a result, the brightness of discharge lamp 43 and discharge lamp 44 is also equalized.

In this circuit, a pair of discharge lamp 43 and discharge lamp 44 forms a pseudo U-tube shape. For this reason, unequalized discharge current generates not only brightness unevenness but also flickers. However, the differential operation of primary windings 41 and 42 of balance coil 40 can prevent the above phenomena.

Further, secondary winding 45 is provided in each of the plurality of balance coils 40, and all of secondary windings 45 are connected in series. This structure can thus equalize discharge current over the plurality of balance coils 40. Accordingly, this structure can keep the pair of discharge lamp 43 and discharge lamp 44 in a pseudo U-tube shape provided in the same number as the number of balance coils 40 in a stable state free from brightness unevenness or flickers.

Third Exemplary Embodiment

Figure 8:
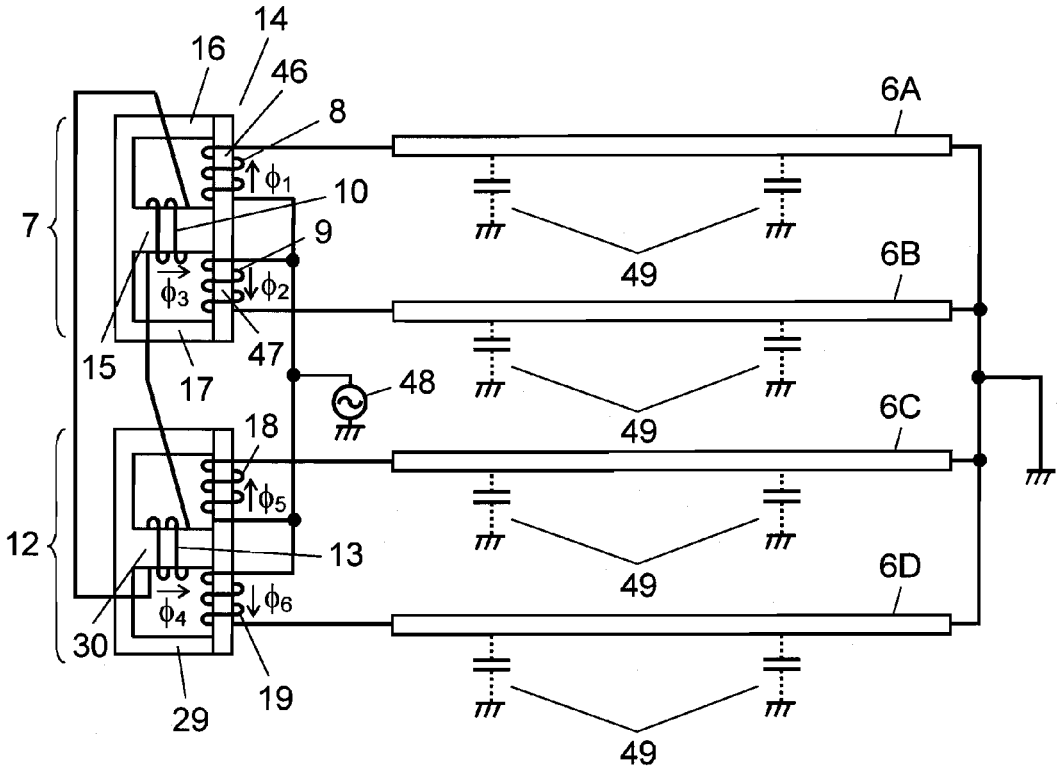
FIG. 8 is a connection diagram of a discharge lamp operating system in accordance with a third exemplary embodiment of the present invention.

FIG. 8 is a connection diagram of a discharge lamp operating system in accordance with the third exemplary embodiment of the present invention. This exemplary embodiment is different from the first exemplary embodiment of FIG. 2 in that power supply 48 is connected to one end of each of primary windings 8, 9, 18, and 19, each of the other ends of primary windings 8, 9, 18, and 19 is connected to one end of each of discharge lamps 6A through 6D, respectively, and the other ends of discharge lamps 6A through 6D are grounded. In other words, in FIG. 2 of the first exemplary embodiment, power supply 5 is connected to the ends of discharge lamps 6A through 6D opposite to balance coils 7 and 12. In contrast, in FIG. 8, power supply 48 is connected to discharge lamps 6A through 6D via balance coils 7 and 12.

Generally, discharge lamps 6A through 6D have stray capacitance 49 between the ground potential and themselves. As well as variations in impedance between discharge lamps 6A through 6D, stray capacitance 49 is an element harmful to stabilization of discharge current. In order to prevent this harmful effect, power supply 48 is connected to discharge lamps 6A through 6D via balance coils 7 and 12. In this structure, current flowing through primary windings 8, 9, 18 and 19 in balance coils 7 and 12 includes current flowing through discharge lamps 6A through 6D and current distributed to stray capacitances 49.

Thus, the current flowing through primary windings 8, 9, 18, and 19 reflects the entire load including discharge lamps 6A through 6D and stray capacitances 49. Therefore, more stable discharge current can be supplied to discharge lamps 6A through 6D.

This advantage is not only offered in each of balance coils 7 and 12 but also over the plurality of primary windings.

Figure 9:
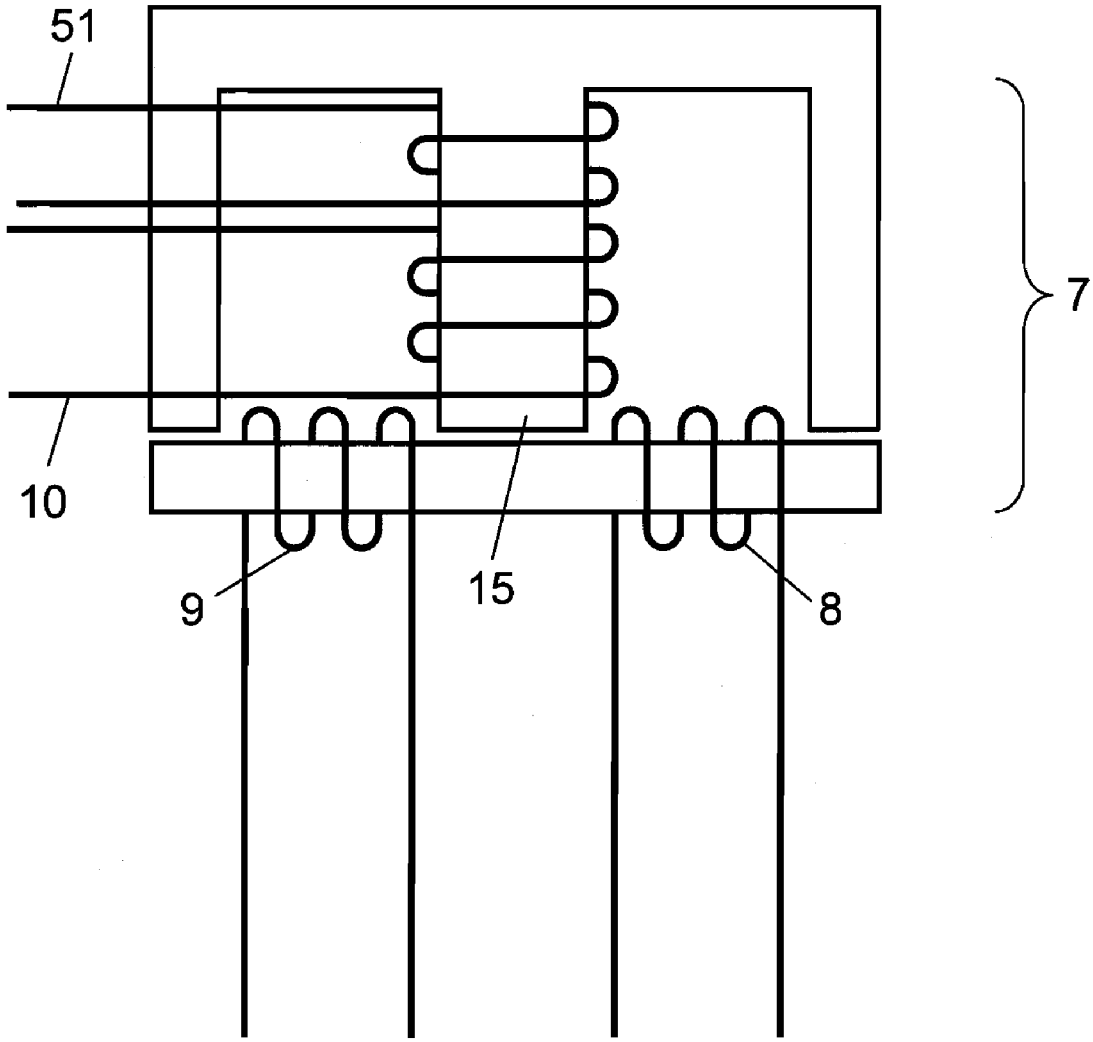
FIG. 9 is a connection diagram of another transformer part of the discharge lamp operating system in accordance with the third exemplary embodiment of the present invention.

Further, in order to stabilize the brightness of discharge lamps 6A through 6D, auxiliary winding 51 for detecting an abnormality may be provided around mid leg 15 of balance coil 7, as shown in FIG. 9. Auxiliary winding 51 is connected to an abnormality detection circuit (not shown). Further, a control circuit (not shown) driven by the abnormality detection circuit can be connected to the discharge lamp operating circuit.

Auxiliary winding 51 may be provided around mid leg 30 of balance coil 12. However, auxiliary winding 51 need not be provided in both balance coils 7 and 12. The plurality of balance coils 7 and 12 in the discharge lamp operating circuits are linked with each other in the loop formed of secondary windings 10 and 13. Thus, an abnormality can be detected only with auxiliary winding 51 provided in one of the plurality of balance coils 7 and 12.

The present invention provides a stable state of light emission free from brightness unevenness in a discharge lamp operating system, and is useful for various types of display devices.

The invention claimed is:

1. A discharge lamp operating system comprising:

a first discharge lamp operating circuit including
- a first primary winding,
- a second primary winding,
- a first secondary winding,
- a first discharge lamp coupled to the first primary winding, and
- a second discharge lamp coupled to the second primary winding;

a second discharge lamp operating circuit including
- a third primary winding,
- a fourth primary winding,
- a second secondary winding coupled in series with the first secondary winding,
- a third discharge lamp coupled to the third primary winding, and
- a fourth discharge lamp coupled to the fourth primary winding;

a first closed magnetic-circuit core including
- a first mid leg,
- a first outer leg and a second outer leg disposed on both sides of the first mid leg,
- a first connecting leg coupling the first mid leg and the first outer leg, and
- a second connecting leg coupling the first mid leg and the second outer leg; and a second closed magnetic-circuit core including
- a second mid leg,
- a third outer leg and a fourth outer leg disposed on both sides of the second mid leg,
- a third connecting leg coupling the second mid leg and the third outer leg, and
- a fourth connecting leg coupling the second mid leg and the fourth outer leg;

wherein the first primary winding is wound around one of the first connecting leg and the first outer leg;

wherein the second primary winding is wound around one of the second connecting leg and the second outer leg;

wherein the first secondary winding is wound around the first mid leg;

wherein a number of turns of the first primary winding is equal to a number of turns of the second primary winding;

wherein the first primary winding and the second primary winding are formed so that magnetic flux generated in the first primary winding and magnetic flux generated in the second primary winding perform a differential operation in the first outer leg, the second outer leg, the first connecting leg, and the second connecting leg;

wherein the third primary winding is wound around one of the third connecting leg and the third outer leg;

wherein the fourth primary winding is wound around one of the fourth connecting leg and the fourth outer leg;

wherein the second secondary winding is wound around the second mid leg;

wherein a number of turns of the third primary winding is equal to a number of turns of the fourth primary winding;

wherein the third primary winding and the fourth primary winding are formed so that magnetic flux generated in the third primary winding and magnetic flux generated in the fourth primary winding perform a differential operation in the third outer leg, the fourth outer leg, the third connecting leg, and the fourth connecting leg;

wherein a number of turns of the first secondary winding is equal to a number of turns of the second secondary winding; and wherein the first secondary winding and the second secondary winding are formed so that current generated in the first secondary winding and current generated in the second secondary winding flow in an identical direction.

2. The discharge lamp operating system according to claim 1, wherein the first closed magnetic-circuit core consists of
- a first E-shaped magnetic core, and
- a first I-shaped magnetic core;

the second closed magnetic-circuit core consists of
- a second E-shaped magnetic core, and
- a second I-shaped magnetic core;

the first primary winding and the second primary winding are wound around the first I-shaped magnetic core;

the first secondary winding is wound around a mid leg of the first E-shaped magnetic core;

the third primary winding and the fourth primary winding are wound around the second I-shaped magnetic core; and the second secondary winding is wound around a mid leg of the second E-shaped magnetic core.

3. The discharge lamp operating system according to claim 1, further comprising an auxiliary winding wound around the first mid leg of the first closed magnetic-circuit core.

4. The discharge lamp operating system according to claim 1, wherein a power supply is coupled to the first primary winding, the second primary winding, the third primary winding, and the fourth primary winding.

5. The discharge lamp operating system according to claim 1, wherein a power supply is coupled in series with the first secondary winding and the second secondary winding.

6. The discharge lamp operating system according to claim 1, wherein the first closed magnetic-circuit core is formed of
- a first E-shaped magnetic core, and
- a first I-shaped magnetic core;

the second closed magnetic-circuit core is formed of
- a second E-shaped magnetic core, and
- a second I-shaped magnetic core;

the first primary winding and the second primary winding are wound around the first I-shaped magnetic core;

the first secondary winding is wound around a mid leg of the first E-shaped magnetic core;

the third primary winding and the fourth primary winding are wound around the second I-shaped magnetic core; and the second secondary winding is wound around a mid leg of the second E-shaped magnetic core.

* * * * *